US006710305B2

(12) United States Patent
Lindemann et al.

(10) Patent No.: US 6,710,305 B2
(45) Date of Patent: Mar. 23, 2004

(54) SHEATH HEATER

(75) Inventors: Gert Lindemann, Lichtenstein (DE); Wilfried Aichele, Winnenden (DE); Andreas Reissner, Stuttgart (DE); Friedericke Lindner, Gerlingen (DE); Christof Rau, Stuttgart (DE); Guenter Knoll, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/169,170

(22) PCT Filed: Oct. 30, 2001

(86) PCT No.: PCT/DE01/04097

§ 371 (c)(1),
(2), (4) Date: Oct. 17, 2002

(87) PCT Pub. No.: WO03/040623

PCT Pub. Date: May 15, 2003

(65) Prior Publication Data

US 2003/0106885 A1 Jun. 12, 2003

(30) Foreign Application Priority Data

Oct. 27, 2000 (DE) ..... 111 53 327

(51) Int. Cl.[7] ..... F23Q 7/22
(52) U.S. Cl. ..... 219/270; 123/145 A
(58) Field of Search ..... 219/267, 270; 123/145 A

(56) References Cited

U.S. PATENT DOCUMENTS 4,814,581 A * 3/1989 Nunogaki et al. ..... 219/270
4,816,643 A * 3/1989 Zulauf et al. ..... 219/270
5,304,778 A * 4/1994 Dasgupta et al. ..... 219/270
5,519,187 A * 5/1996 Hinkle ..... 219/270
5,589,091 A * 12/1996 Muller ..... 219/270
5,676,100 A * 10/1997 Dam et al. ..... 123/145 A
6,049,065 A * 4/2000 Konishi ..... 219/270
6,064,039 A * 5/2000 Kumada ..... 219/270
6,184,497 B1 * 2/2001 Leigh ..... 219/270
6,396,028 B1 * 5/2002 Radmacher ..... 219/270

FOREIGN PATENT DOCUMENTS

| | | | | |
|---|---|---|---|---|
| EP | 1 065 446 | | 1/2001 | |
| EP | 1 092 696 | | 4/2001 | |
| JP | 401140582 | * | 6/1989 | ..... H05B/3/56 |
| WO | WO 96/27104 | | 9/1996 | |
| WO | WO 00/35830 | | 6/2000 | |

* cited by examiner

*Primary Examiner*—Sang Y. Paik
*Assistant Examiner*—L. Fastovsky
(74) *Attorney, Agent, or Firm*—Kenyon & Kenyon

(57) ABSTRACT

A sheath heater in a sheathed-type glow plug for diesel engines is described, having at least one generally internal insulation layer and at least one generally external conductive layer, both layers making up a ceramic composite structure. The sheath heater has a generally uniform overall cross-section, generally over its entire length, and, in the area of a tip of the sheath heater, the proportion of the insulation layer in the overall cross-section increases, whereas the proportion of the conductive layer in the overall cross-section decreases.

13 Claims, 4 Drawing Sheets

A - A

B - B

SHEATH HEATER

FIELD OF THE INVENTION

The present invention relates to a sheath heater, especially for use in a sheath-type glow plug for diesel engines.

BACKGROUND INFORMATION

The technology of modern diesel engines places great demands on sheathed-type glow plugs, especially with regard to size, sturdiness, rapidity of heating-up, and resistance to high temperatures. It is usually desirable that, at a heater output of roughly 70 to 100 W, a temperature of 1000° C. and a steady-state temperature of 1200° C. can be achieved within 2 seconds.

Conventional sheathed-type glow plugs have metallic and ceramic heaters. Customary designs of ceramic sheathed-type glow plugs have internal metallic or ceramic heaters, which are sintered into a nonconductive ceramic that is stable at high temperatures. However, sheathed-type glow plugs having this type of design can only be manufactured using expensive heat pressing methods. On the other hand, sheathed-type glow plugs having external heaters made of composite ceramics can be manufactured using simpler and more cost-effective sintering methods.

A diesel-engine glow plug having a cylindrical metal tube, a connecting device for the electoral contact, and a ceramic heating device, is described in, for example, PCT Application WO 96/27104. In this glow plug, the cylindrical metal tube at its tip supports the ceramic heating device in a floating manner, the ceramic heating device being contacted using the connecting device, so that during the glow process a current flows through the ceramic heating device.

In this context, the ceramic heating device has at least one location having a reduced cross-section, the reduction of the cross-section of the ceramic heating device occurring at the location at which the fuel-air mixture strikes. The cross-section reduction in this ceramic heating device is realized such that the thickness of the lateral wall is correspondingly reduced at the location in question.

In a sheathed-type glow plug of this type, it is possible that the area of the heating device that is most accessible to the combustible mixture reaches the necessary ignition temperature the most rapidly due to the resulting greater resistance. As a result, shorter heating-up times are possible for the sheathed-type glow plugs. A defined reduction of the wall thickness of this magnitude makes it possible to bring to the highest temperature precisely the location of the sheathed-type glow plug where the combustion mixture strikes.

In PCT Application No. WO 00/35830, a further conventional solution is described for creating a rapidly self-heating sheath heater, achieving this by reducing the cross-section of the sheath heater in the area of the hot zone. A sheath heater of this type, for the purpose of cross-section reduction, is configured having a filigree tip.

Conventional sheath heaters of this type have the disadvantage that they have a hot zone that must be created in an extremely finely fashion by forming a pointed tip or otherwise reducing the cross-section in the area of the tip of the sheath heater, in order to be able to be heated rapidly to a high temperature.

However, filigree tips of sheath heaters, that are therefore only capable of standing up to small stresses, are extremely sensitive and can be easily damaged, especially during handling, installation in the engine, etc.

Furthermore, areas of sheath heaters that are reduced in their cross-section in this manner also have an insufficient thermal mass, so that it is impossible to achieve satisfactory temperature stability, and therefore in response to a sudden cooling in the environment, such as during a cold start of the engine, the danger of blowing out the sheathed-type glow plug is very great.

SUMMARY

In accordance with an example embodiment of the present invention, a sheath heater in a sheathed-type glow plug for diesel engines may have the advantage that, as a result of the changed shape of the tip of the sheath heater, it is possible to achieve significantly greater mechanical stability, because the tip of the sheath heater is not reduced in its overall cross-section.

In addition, the heater tip may have a greater thermal mass. This has the effect, under certain operating conditions, specifically in a cold start, of working against a blow-out of the sheathed-type glow plug.

According to one example embodiment of the sheath heater, the latter is configured so as to be generally rotationally symmetrical. This may be advantageous because, as a result of a sheath-heater configuration of this type, it is possible that the glow plug glows in its central tip area, as is required for modern, direct-injection diesel engines.

In this context, in configuring the sheath heater, it can be provided that the insulation layer is generally surrounded by the conductive layer.

It has been demonstrated that it is advantageous, especially for the production of the sheath heater, if the insulation layer is surrounded by the conductive layer in a generally sandwich-like manner, i.e., if the cross-section includes a sequence of conductive layer, a central insulation layer, and once again a conductive layer, the insulation layer being situated at least approximately in a central area of the cross-section of the sheath heater.

It may be advantageous if the sheath heater is manufactured by injection-molding, and if the insulation layer is injection-molded first, the insulation layer extending, in its edge area, i.e., the area not bordering on the conductive layer, at least in part right to the periphery of the sheath heater. As a result, the insulation layer can be placed in a tool so the conductive layer can be sprayed on, for example, perpendicular to the tool parting plane.

In particular, with regard to the size of the sheath heater, which may be kept very small, it may be advantageous if the sheath heater has a diameter in the range of roughly 2 mm to 5 mm.

It is expedient if the arrangement of the conductive layer and the insulation layer is optimized for the specific manufacturing process of the sheathed-type glow plugs. Preferred manufacturing processes are injection molding and/or injection pressing. The optimization advantageously takes place using analytic processes, in particular, using a finite-element process. Using an optimization of this type, it is possible to calculate a geometry of the sheath heater which can be produced very simply and cost-effectively using a two-stage injection-molding process, without reworking and subsequent sintering.

In this context, it is preferred if the ceramic composite structure of the conductive and insulation layers has as constituents tri-silicon tetra nitride and a metallic silicide. In this context, it is greatly preferred if the ceramic composite structure for the conductive layer be made of 60 wt. %

$MoSi_2$ and 40 wt. % $Si_3N_4$, as well as sintering additives, and for the insulation layer to be made of 40 wt. % $MoSi_2$ and 60 wt. % $Si_3N_4$, as well as sintering additives.

BRIEF DESCRIPTION OF THE DRAWINGS

Three example embodiments of the sheath heater according to the present invention in a sheathed-type glow plug for diesel engines are schematically depicted in the drawing and are discussed in greater detail in the description below.

DETAILED DESCRIPTION

Figure 1:
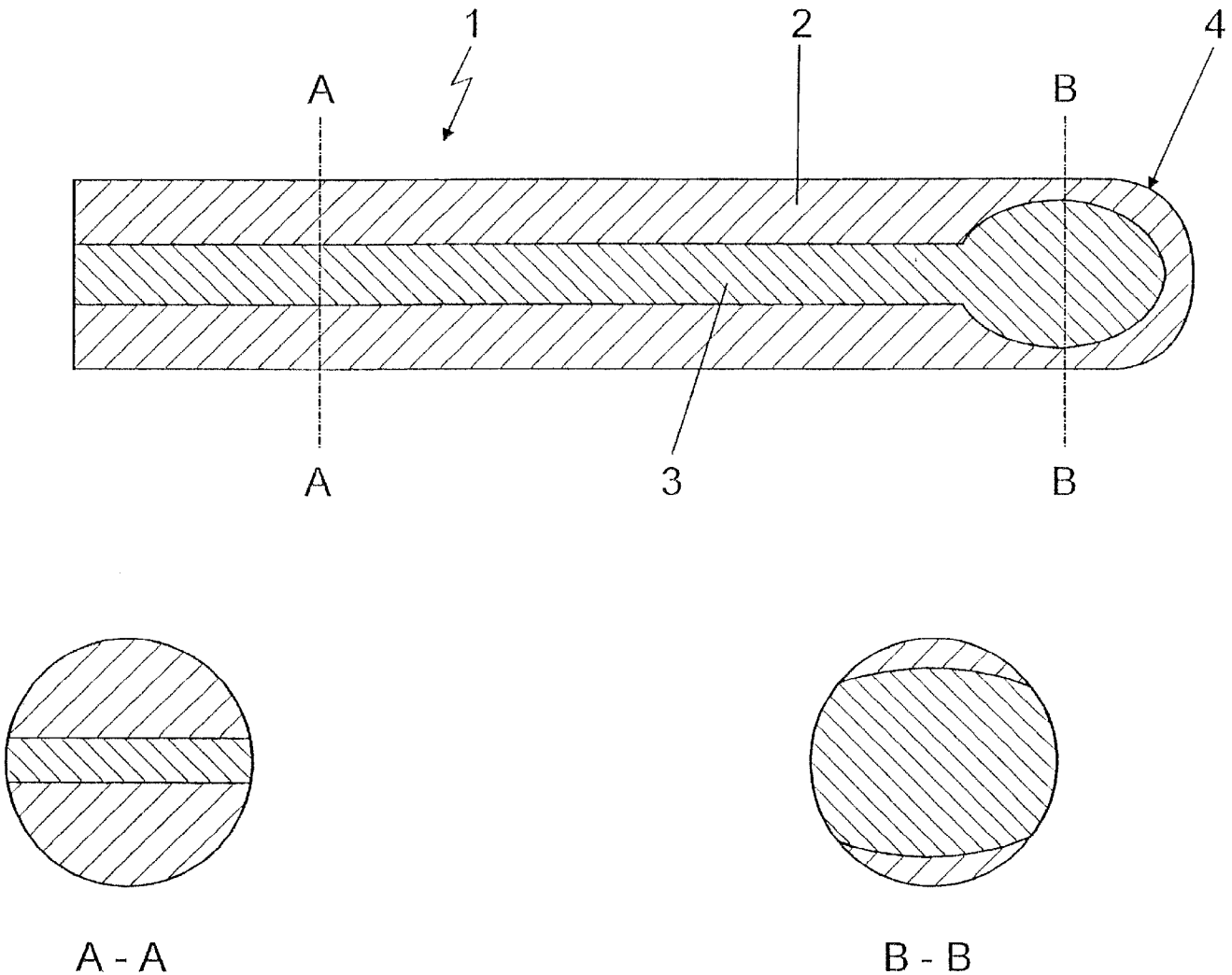
FIG. 1 depicts a longitudinal cutaway view of a sheath heater, having two associated cross-sections, along the lines A—A and B—B, in accordance with a first example embodiment of the present invention.
Figure 2:
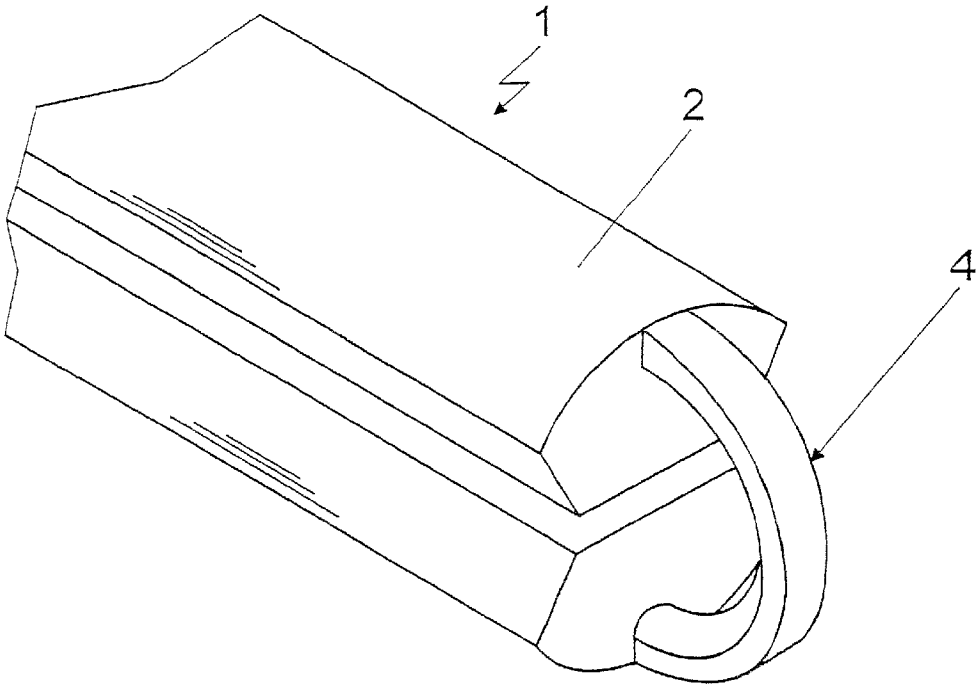
FIG. 2 depicts a conductive layer, optimized using a finite-element calculation, of a tip area of a sheath heater according to a second example embodiment.
Figure 3:
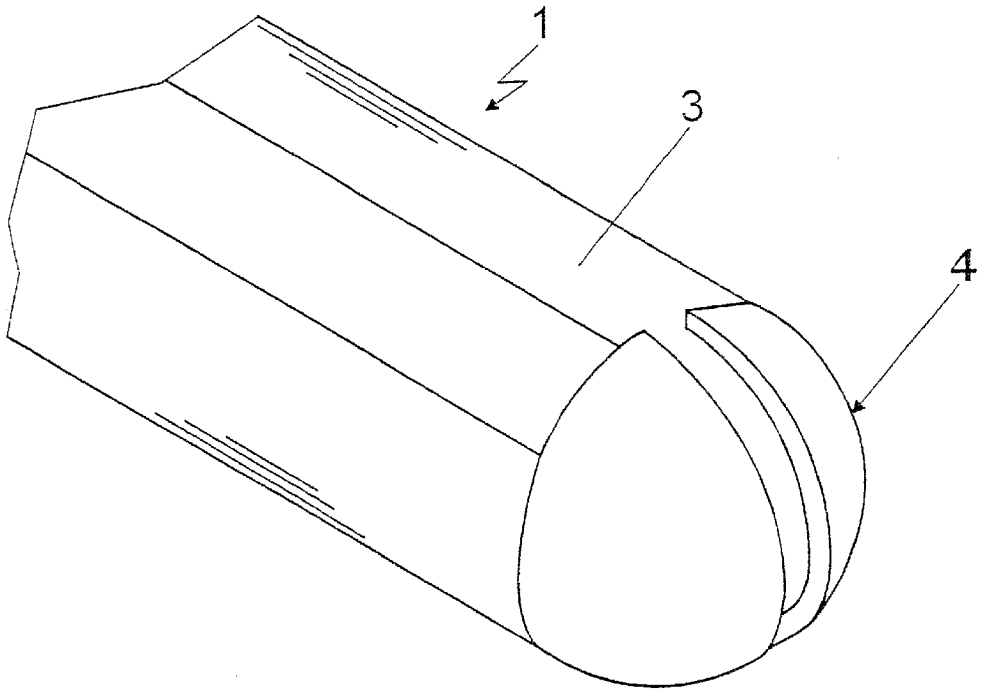
FIG. 3 depicts the insulation layer that is associated with the conductive layer depicted in FIG. 2.
Figure 4:
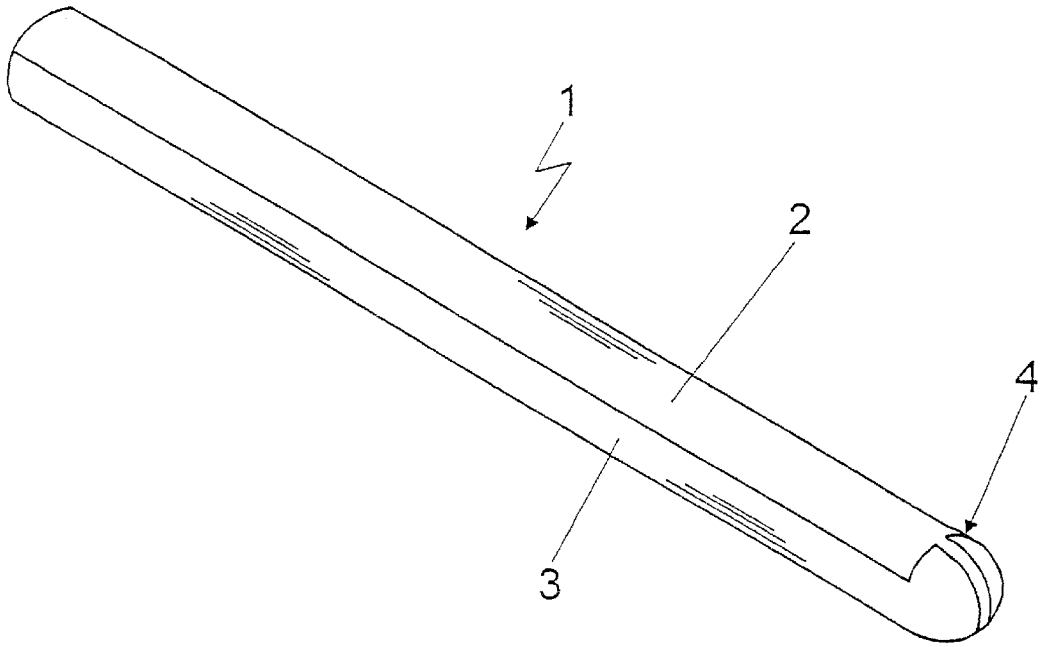
FIG. 4 depicts a three-dimensional representation of a sheath heater according to FIGS. 2 and 3.
Figure 5:
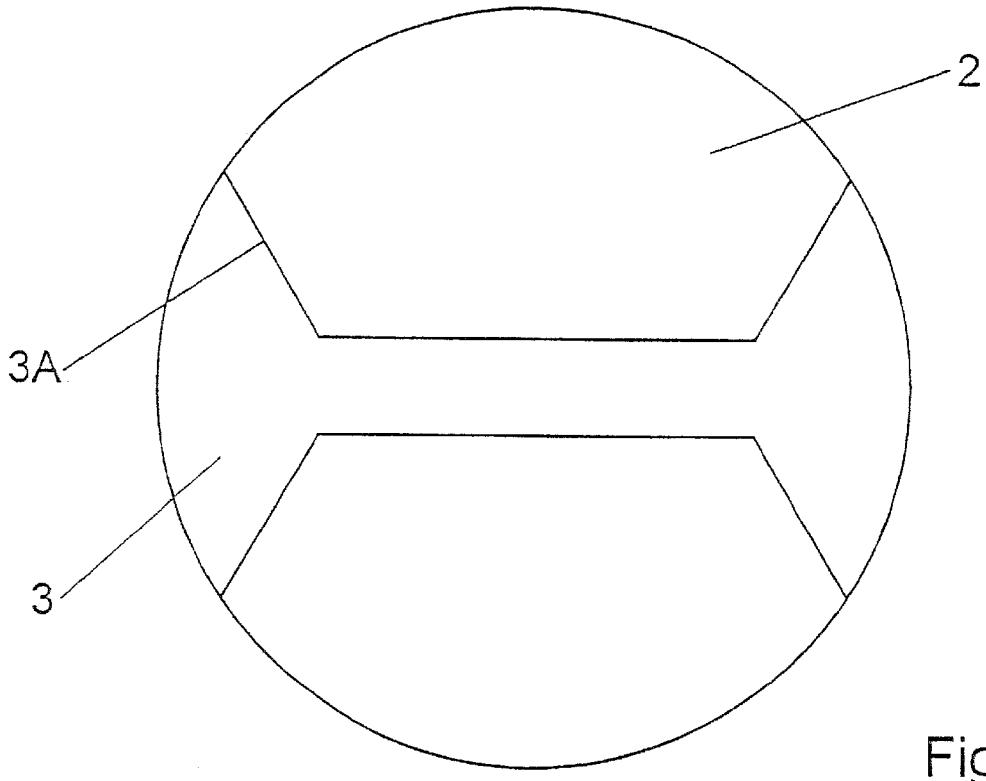
FIG. 5 depicts a view from the rear of the sheath heater according to the embodiment depicted in FIGS. 2 through 4.

In FIG. 1, a sheath heater 1 is depicted in a longitudinal cutaway view, a conductive layer 2 being generally external and an insulation layer 3 being generally internal, insulation layer 3 being surrounded by conductive layer 2 in a sandwich-like manner. Both layers 2, 3 constitute a ceramic composite structure.

This sheath heater 1, as can be seen in FIG. 1, has a uniform overall cross-section over its entire length, insulation layer 3 in the area of a tip 4 of sheath heater 1 undergoing a cross-sectional expansion, whereas the portion of external conductive layer 2 is correspondingly reduced in comparison to the overall cross-section.

As can be seen, in particular, from the appropriate cross-sections along the lines A—A and B—B in FIG. 1, the sheath heater according to the example embodiment is configured in a symmetrical fashion. Symmetrical, in this context, can denote a symmetry about an axis of symmetry lying in the cross-sectional plane, or a symmetry about a rotational axis along the axis of the sheath heater in a crystallographic sense.

A ceramic sheath heater 1 having an external heater has a diameter suitable for installation in an M8 housing. For this purpose, a diameter of roughly 3.3 mm may be advantageous for sheath heater 1.

By appropriately selecting the geometry of conductive layer 2 and of insulation layer 3, as depicted in FIG. 1, it is possible to reduce the cross-section of conductive layer 2 in tip area 4, entire sheath heater 1 having generally one uniform cross-section over its entire length. In this manner, it is possible for sheath heater 1 to glow rapidly in tip area 4, as is required for modern, direct-injection diesel engines, while nevertheless having good mechanical stability.

In FIGS. 2 through 5, in which for reasons of clarity the same reference numerals for functionally equivalent components are used as in FIG. 1, a sheath heater 1 is depicted, whose shape, more specifically the shape of conductive layer 2 with respect to insulation layer 3, has been optimized using an analytic method, the optimization being carried out with reference to the manufacturing process of sheath heater 1, specifically with regard to an injection-molding process.

A sheath heater 1 of this type can be realized using a simple injection-molding process, insulation layer 3 being pre-injected in a pre-shaped tool, and ceramic conductive layer 2 being injected around insulation layer 3 in a second working step.

An expansion 3A, depicted in FIGS. 2 to 5, of insulation layer 3 at the edges of sheath heater 1 increases the injection-molding capacity of sheath heater 1 of this type as well as the positional stability of insulation layer 3 in the tool for injecting conductive layer 2. In this way, an injection-molding of sheath heater 1 is possible without material residues, which complicate the aftertreatments.

In accordance with the depicted second exemplary embodiment for composite ceramics, for example, using $Si_3N_4$ and $MoSi_2$ the geometry is optimized. In this context, conductive layer 2 is made up at least roughly of 60 wt. % $MoSi_2$, 40 wt. % $Si_3N_4$, as well as sintering additives, and insulation layer 3 is made up of 40 wt. % $MoSi_2$, 60 wt. % $Si_3N_4$, and sintering additives.

To produce the injection-molding masses, the powder mixtures are mixed together with a polypropylene that is treated using acrylic acid or maleic acid anhydride, such as polybond 1000 binders and cyclododecane, or cyclododecanol as auxiliary materials, which have a total proportion of 15 to 20 wt. % of the injection-molding mass.

In FIGS. 6*a*) through *c*), a sheath heater 1 that is even further optimized with respect to its manufacturing process is depicted in a cross-sectional cutaway view (FIG. 6*a*), in a longitudinal section (FIG. 6*b*), as well as in a top view (FIG. 6*c*)

In this context, the transitions between insulation layer 3 and conductive layer 2 have been rounded, or rounded off, which also may be advantageous with regard to the injection-molding, because after conductive layer 2 is sprayed on, no spikes of thermal stresses occur at sharp edges and corners.

In the cross-sectional representation of FIG. 6*a*, once again the shape of sheath heater 1, which is optimized with respect to the aforementioned material and the injection method, can be seen more clearly as a result of exemplary size specifications. In this context, diameter d1 of the sheath heater is 3.3 mm, width b1 of insulation layer 3, between the shoulders, is 1.9 mm to 2 mm, the thickness, i.e., the diameter, of heating channel d2 is 0.35 mm, and the thickness of the insulation layer is 0.8 mm. Advantageously, angle $\alpha$ of the insulation-layer shoulder is 120°.

Figure 6:
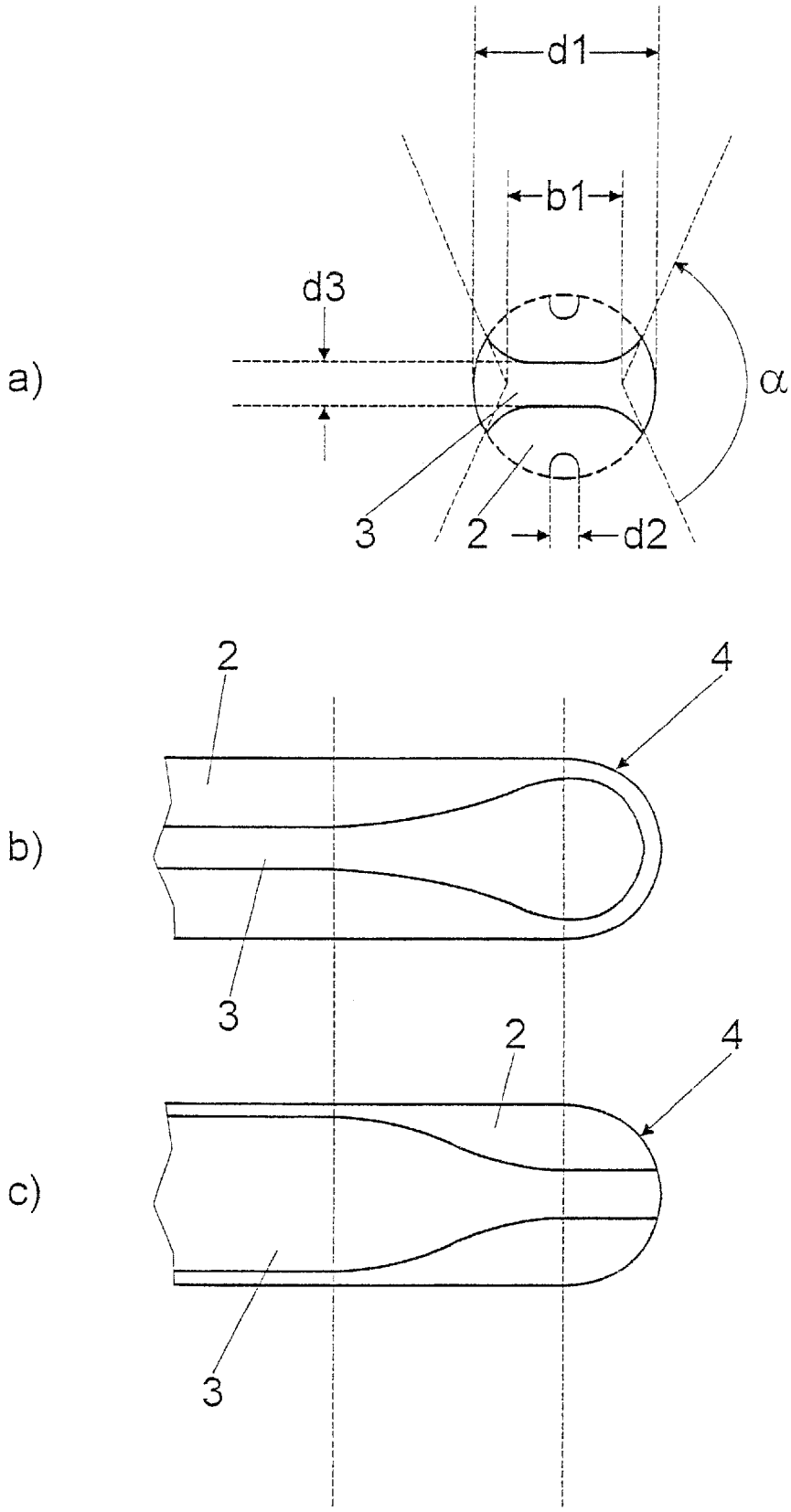
FIGS. 6*a*) through *c*) depict a cross-section, a longitudinal cutaway view, as well as a top view of a sheath heater according to a third example embodiment of the present invention.

Sheath heater 1, depicted in FIG. 6, is also generally a sheath heater 1 having a sandwich-like design, in which insulation layer 3 is disposed generally between conductive layers 2, insulation layer 3 running at least partially up to the edge of sheath heater 1.

By way of example, the sequence of the injection-molding of a sheath heater is briefly explained below.

In a first segment, insulation layer 3 is injection-molded. In this context, the first view is at the thickest point of insulation layer 3, i.e., in accordance with the present invention, it is in the area of tip 4. Assuming a length of conductive layer 2 of roughly 50 mm, it is currently possible in a metallic tool to injection-mold a layer thickness of a minimum of 0.8 mm. If a heat insulating layer is applied to the surface of the cavity of the injection-molding tool, such as $Al_2O_3$, $ZrO_3$, or the like, then even thinner insulation layers 3 can be injection-molded.

Subsequently, this insulation layer 3 is placed in the tool perpendicular to the tool parting plane, i.e., standing up, and conductive layer 2 is sprayed on.

In this context, the spraying takes place at the foot, the spraying-over of insulation layer 3 using conductive material takes place from the foot to tip 4. In this context, the surface of insulation layer 3 melts in a short time and binds to conductive layer 2. The contour of insulation layer 3 at the tool wall is configured so as to have four edges, so that these edges can easily be reached by the melted mass of the conductive layer, i.e., can be fused. The rounded-off transitions are especially provided for this purpose.

On the other hand, if insulation layer 3 and conductive layer 2 are not designed to melt immediately in the area of the surface of the cavity, then the tool surface can once again be provided with a heat insulating layer in the area of the transition of insulation layer 3 and conductive layer 2.

Subsequently, the material mass of the conductive layer is machined off at the foot up to the beginning of insulation layer 3, so that the foot area is not electrically short-circuited. A thermal release and a sintering then follows.

What is claimed is:

1. A sheath heater in a sheathed-type glow plug for a diesel engine, comprising:

at least one generally internal insulation layer; and at least one generally external conductive layer, the at least one generally internal insulation layer and the at least one generally external conductive layer together forming a ceramic composite structure;

wherein the sheath heater has a uniform overall cross-section along an entire length of the sheath heater, and, in an area of a tip of the sheath heater, a proportion of the insulation layer in an overall cross-section increases relative to a remaining portion of the sheath heater, and a proportion of the conductive layer in the overall cross-section decreases relative to the remaining portion of the sheath heater.

2. The sheath heater as recited in claim 1, wherein the cross-section is configured so as to be generally symmetrical.

3. The sheath heater as recited in claim 1, wherein the insulation layer generally surrounded by the conductive layer.

4. The sheath heater as recited in claim 1, wherein the insulation layer is surrounded by the conductive layer in a sandwich-like manner.

5. The sheath heater as recited claim 1, wherein the sheath heater has an overall diameter in a range of 2 mm to 5 mm.

6. The sheath heater as recited in claim 1, wherein a shape of the conductive layer and of the insulation layer with respect to each other is optimized using a manufacturing process.

7. The sheath heater as recited in claim 6, wherein the optimization is carried out using an analytic method.

8. The sheath heater as recited in claim 7, wherein the analytic method is a finite-element method.

9. The sheath heater as recited in claim 8, wherein the finite-element method is supplemented by a statistical evaluation method.

10. The sheath heater as recited in claim 1, wherein the sheath heater is manufactured using at least one of an injection-molding method and injection-pressing method.

11. The sheath heater as recited in claim 1, wherein the ceramic composite structure has as constituents tri-silicon tetra nitride and a metallic silicide.

12. The sheath heater as recited in claim 11, wherein the conductive layer is made of 60 wt. % $MoSi_2$, 40 wt. % $Si_3N_4$, and sintering additives, and the insulation layer is made of 40 wt. % $MoSi_2$, 60 wt. % $Si_3N_4$, and sintering additives.

13. The sheath heater as recited in claim 1, wherein the ceramic composite structure is formed based on a SiOC-glass ceramic derived from polysiloxane and having sillers and a metallic silicide.

* * * * *

UNITED STATES PATENT AND TRADEMARK OFFICE

CERTIFICATE OF CORRECTION

PATENT NO. : 6,710,305 B2
DATED : March 23, 2004
INVENTOR(S) : Gert Lindemann et al.

It is certified that error appears in the above-identified patent and that said Letters Patent is hereby corrected as shown below:

Column 1,
Line 27, change "the electoral contact," to -- electrical contact, --
Line 61, change "extremely finely fashion" to -- extremely fine fashion --.

Column 6,
Line 5, change "layer generally surrounded" to -- layer is generally surrounded --.
Line 11, change "recited claim 1," to -- recited in claim 1, --.

Signed and Sealed this

Fifth Day of October, 2004

JON W. DUDAS
*Director of the United States Patent and Trademark Office*